US005304451A

United States Patent [19]

Felder et al.

[11] Patent Number: 5,304,451

[45] Date of Patent: Apr. 19, 1994

[54] METHOD OF REPLENISHING A LIQUID DEVELOPER

[75] Inventors: Thomas Felder, Pannal, United Kingdom; Ronald Koch; Lalit M. Bhalla, both of Webster, N.Y.

[73] Assignee: Xerox Corporation, Stamford, Conn.

[21] Appl. No.: 812,660

[22] Filed: Dec. 23, 1991

[51] Int. Cl.[5] ..... G03G 9/12

[52] U.S. Cl. ..... 430/137

[58] Field of Search ..... 430/114, 115, 137, 117

[56] References Cited

U.S. PATENT DOCUMENTS

| | | | |
|---|---|---|---|
| 2,899,335 | 8/1959 | Straughan | 430/112 |
| 3,336,906 | 8/1967 | Michalchik | 430/112 |
| 3,397,254 | 8/1968 | Wynstra et al. | 260/835 |
| 3,900,412 | 8/1975 | Kosel | 252/62.1 |
| 3,900,512 | 8/1975 | Sih | 260/468 |
| 3,963,486 | 6/1976 | Tamai et al. | 96/1 |
| 3,968,044 | 7/1976 | Tamai et al. | 252/62.1 |
| 3,998,747 | 12/1976 | Yamakami et al. | 252/62.1 |
| 4,052,325 | 10/1977 | Santilli | 252/62.1 |
| 4,134,881 | 1/1979 | Cuddihy et al. | 528/299 |
| 4,157,974 | 6/1979 | Brechlin et al. | 252/62.1 |
| 4,202,785 | 5/1980 | Merrill et al. | 430/106 |
| 4,275,189 | 6/1981 | Danick et al. | 528/296 |
| 4,484,333 | 11/1984 | Hikake et al. | 241/5 |
| 4,507,377 | 3/1985 | Alexandrovich | 430/115 |
| 4,543,313 | 9/1985 | Mahabadi et al. | 430/109 |
| 4,557,991 | 12/1985 | Takagiwa et al. | 430/109 |
| 4,631,244 | 12/1986 | Mitchell | 430/137 |
| 4,659,640 | 4/1987 | Santilli | 430/119 |
| 4,702,984 | 10/1987 | El-Sayed et al. | 430/115 |
| 4,702,985 | 10/1987 | Larson | 430/115 |
| 4,707,429 | 11/1987 | Trout | 430/137 |
| 4,734,352 | 3/1988 | Mitchell | 430/115 |
| 4,740,444 | 4/1988 | Trout | 430/137 |
| 4,740,580 | 4/1988 | Merck et al. | 528/27 L |
| 4,812,377 | 3/1989 | Wilson et al. | 430/109 |
| 4,833,057 | 5/1989 | Misawa et al. | 430/109 |
| 4,844,349 | 7/1989 | Kanda et al. | 241/19 |
| 4,859,560 | 8/1989 | Nakamura et al. | 430/137 |
| 4,877,704 | 10/1989 | Takagiwa et al. | 430/99 |
| 4,900,647 | 2/1990 | Hikake et al. | 430/137 |
| 4,917,309 | 4/1990 | Zander et al. | 241/5 |
| 4,923,778 | 5/1990 | Blair et al. | 430/137 |
| 4,925,763 | 5/1990 | Tsubuko et al. | 430/106 |
| 4,930,707 | 6/1990 | Oshiro et al. | 241/24 |
| 4,935,252 | 6/1990 | Nishikawa et al. | 430/109 |
| 4,935,327 | 6/1990 | Takizawa et al. | 430/110 |
| 4,966,825 | 10/1990 | Suzuki et al. | 430/137 |
| 4,981,923 | 1/1991 | Hagiwara et al. | 525/440 |
| 4,988,600 | 1/1991 | Jongewaard et al. | 430/114 |
| 4,988,602 | 1/1991 | Kok et al. | 430/110 |
| 5,006,441 | 4/1991 | Kato | 430/114 |
| 5,006,612 | 4/1991 | Danick et al. | 525/438 |
| 5,017,451 | 5/1991 | Larson et al. | 430/137 |
| 5,037,715 | 8/1991 | Hagiwara et al. | 430/109 |
| 5,116,705 | 5/1992 | Materazzi | 430/114 |
| 5,155,001 | 10/1992 | Landa et al. | 430/137 |

*Primary Examiner*—John Goodrow
*Attorney, Agent, or Firm*—Oliff & Berridge

[57] ABSTRACT

A dry toner is added to a liquid carrier to replenish a liquid developer in an electrostatographic printing machine.

20 Claims, No Drawings

METHOD OF REPLENISHING A LIQUID DEVELOPER

FIELD OF THE INVENTION

1. Field of the Invention

The present invention relates to a method for replenishing liquid developer in an electrostatographic printing machine.

2. Background

An electrostatographic printing machine such as a photocopier, laser printer, facsimile machine or the like employs an imaging member that is exposed to an image to be printed. Exposure of the imaging member records an electrostatic latent image on it corresponding to the informational areas contained within the image to be printed. The latent image is developed by bringing a developer material into contact therewith. The developed image is transferred to a support material such as paper either directly or via an intermediate transport member. The developed image on the support material is generally subjected to heat and/or pressure to permanently fuse it thereto.

Many types of developer compositions, including both dry developer compositions and liquid developer compositions, have been proposed for use in the development of latent electrostatic images. Dry developer compositions typically suffer from the disadvantage that distribution of the dry toner powder contained therein on the surface of the element bearing the latent image is difficult to control. These dry developers have the further disadvantage that the use thereof may create excessive amounts of dust and that high resolution is often difficult to obtain due to the generally relatively large size of the dry developer powder particles.

Many of the disadvantages accompanying the use of dry developer compositions have been avoided by the use of liquid developers. Liquid developers have a number of advantages over the use of dry developers. Because liquid developers contain smaller toner particles than dry developers, they produce higher resolution images. As liquid developers are pumped through tubing within the machines there are no dusting problems that commonly arise with the use of dry developers. Additionally, because liquid developers are not tribocharged, they are less sensitive to humidity. Liquid developers are usually comprised of an electrically insulating liquid which serves as a carrier and which contains a stable dispersion of charged particles known as toner particles comprising a pigment such as carbon black, generally associated with a resinous binder, such as, for example, an alkyd resin. A charge control agent is often included to stabilize the magnitude and polarity of the charge on the toner particles. In some cases, the binder itself serves as a charge control agent. Liquid developers can also have soluble ionic material in solution known as charge directors which impart a charge on the toner particles.

To achieve suitable physical stability of the toner particles dispersed in conventional liquid electrographic developers, any of several types of various "stabilization" additives are incorporated to prevent the toner particles from settling out of the carrier liquid. However, stabilized liquid developer compositions tend to become "deactivated" within a few weeks and the toner particles tend to agglomerate or settle out of the developer. Consequently, the resultant liquid developer composition containing conventional liquid developer toner particles tends to become incapable of producing electrostatic prints of good quality and density. Once the toner particles settle out of the developer suspension, it is often difficult to redisperse them, and, even if redispersed, it is often found that the redispersed liquid developer does not possess the same developer characteristics as the original developer.

Because stabilization in liquid developers has been and is still a difficult problem to overcome, liquid developers are often prepared in the form of so-called "concentrates", i.e., mixtures of resins, pigments and/or dyes with a low liquid content. (See Santilli, U.S. Pat. No. 4,052,325.) These concentrates are stable and exhibit a relatively long shelf life. The loss of stability which occurs in conventional liquid developers, as noted hereinabove, occurs primarily in the diluted form of the concentrate which is the "working" form of the developer, i.e., the form of developer composition actually used in most electrographic developing processes.

Stability in "working" liquid developer compositions may be improved to some extent by the use of the various stabilization agents disclosed in U.S. Pat. No. 2,899,335 (York). These additives are most effective in a developer when used in conjunction with toner particles having a very small particle size. However, even in these situations where stability is achieved in working developers, this stability is often accompanied by too high a developer sensitivity which tends to result in a high degree of background density in the resultant liquid developed electrographic images.

Another problem associated with conventional "stabilized" liquid developers has been the problem of replenishment. Once the developer is used to produce a number of developed images, the developer becomes depleted of toner particles and must be replenished.

In addition to the "stabilized" liquid developers described above, various "redispersible" liquid developers have been formulated which are characterized by toner particles which, upon settling out of suspension with the liquid carrier vehicle of the developer, are readily redispersed in the liquid carrier and, when so redispersed, exhibit developer characteristics similar to the original developer. However, various problems still exist with many of these "redispersible" developers. For example, the toner particles of many of these developers cannot be readily fixed, except to rough-surfaced toner image receiving sheets such as conventional zinc oxide coated papers, using preferred fixing temperatures of about 100° C. or less. These developers, therefore, cannot be employed, except with further binder addenda, in various transfer processes because these processes use smooth surfaced toner-image receiving elements, such as dielectric resin-coated papers, i.e., papers coated with a film-forming dielectric resin. Still other available redispersible developers, although redispersible at ordinary room temperatures, exhibit pronounced caking or agglomeration of the toner particles when subjected to extended periods of storage (e.g., 24 hours) at temperatures above room temperature, and cannot be readily dispersed.

U.S. Pat. No. 4,052,325 (Santilli) discloses a liquid developer containing heat-fixable toner particles, wherein the toner particles contain a linear polyester polymer. The polyester polymer may have a structural formula as follows:

$$-(O-R-O-\overset{O}{\overset{\|}{C}}-R'-\overset{O}{\overset{\|}{C}})_{100-x}(O-R^2-O-\overset{O}{\overset{\|}{C}}-R^3-\overset{O}{\overset{\|}{C}})_x$$

A process of preparing the liquid developer comprises the steps of: (1) dissolving the polyester polymer in a suitable solvent in a ball mill wherein a pigment or other additives may be added forming a polymer-solvent mixture; (2) separating the mixture from the milling beads and the solvent; and (3) grinding the resulting dry polymer-containing material in a ball mill with a small amount of a liquid carrier vehicle creating a developer concentrate.

U.S. Pat. No. 4,659,640 (Santilli) discloses a liquid electrographic developer containing polyester based toner particles and special waxes. Preferred polyester binders have recurring diacid-derived units having the formula:

$$-O-G^1-O-$$

wherein $G^1$ represents straight or branched-chain alkylene having about 2 to 12 carbon atoms or cycloalkylene, cycloalkylenebis(oxyalkylene) or cycloalkylene-dialkylene; and aliphatic, alicyclic or aromatic dicarboxylic acid recurring units which preferably contain sulfur. A process of preparing the liquid developer comprises the steps of: (1) melt-blending the polyester binder and a wax at a temperature above the melting temperature of the amorphous polyester; (2) cooling the blend; (3) pulverizing the blend; (4) dispersing the blend in a volatile carrier; and ball milling the resulting dispersion to form toner particles incorporating both the wax and the polyester.

U.S. Pat. No. 4,812,377 (Wilson et al.) discloses dry or liquid developers having finely divided toner particles comprising a fusible branched chain polyester resin. The toner compositions can be ground to a very small particle size. A process of preparing a solid polyester polymer composition comprises the steps of: (1) crushing the polymer and then melt-blending with a colorant; (2) cooling and solidifying the blended composition; (3) crushing and coarsely grinding the composition in a mechanical mill; and (4) pulverizing the coarsely ground composition to a size of 1 mm; (5) adding the coarsely ground toner to Isopar® G and ball milling and shearing the composition with other additives for several days.

U.S. Pat. No. 4,784,333 (Hikake et al.) discloses dry colored resinous particles suitable for use in toner powder for developing electrostatic latent images which are produced from a pulverized feed. The process comprises the steps of: (1) preparing a pulverized feed material by melt-kneading a composition comprising a binder resin and a colorant or magnetic material, cooling and solidifying the kneaded product, and pulverizing the solidified product; (2) introducing the pulverized feed material into a first classification step to classify the feed material into a first coarse powder and a first classified fine powder; (3) introducing the classified first coarse powder into a first pulverizing step to pulverize the coarse powder; (4) introducing the resultant pulverized product of the first coarse powder into the first classification step together with the pulverized feed material; (5) introducing the first classified fine powder into a second classification step to classify the fine powder into a second coarse powder and a second classified fine powder; (6) introducing the classified second coarse powder into a second pulverization step to pulverize the coarse powder; and (7) introducing the resultant pulverized product of the second coarse powder into the first classification step or second classification step. The pulverizers may be an impact-type pulverizer or jet-type pulverizer. The classifiers may be a fixed wall-type centrifugal air classifier. The pulverized feed material may be prepared by melt-kneading the premixed composition by a hot kneading means such as heated rollers, a kneader or an extruder.

U.S. Pat. No. 4,900,647 (Hikake et al.) discloses a process for producing dry toner particles for developing electrostatic latent images comprising the steps of: (1) pulverizing a resinous material comprising at least a binder resin by a micro-pulverizing means; (2) classifying the resinous particles by a classifying means; and (3) smoothing the classified particles. The base particles may be prepared by pulverizing a resin or by melt-kneading a mixture comprising a binder resin and an additive such as a pigment, a charge control agent, and a release agent, by means of a machine such as an extruder or kneader; cooling and solidifying the kneaded product; and pulverizing the solidified product. The thus pulverized product may be classified by a classifier, and is then smoothed. The smoothing process may be done by heat-treating the particles, jet-milling the particles under a reduced pulverization pressure, etc.

U.S. Pat. No. 4,844,349 (Kanda et al.) discloses a process for producing a dry toner by: (1) classifying a pulverized feed material into a coarse powder and a fine powder in a first classifying means; (2) pulverizing and recycling the coarse powder to the first classifying means; and (3) introducing the fine powder into a multi-division classifying chamber divided into at least three sections. The three sections for the fine powder are a coarse powder fraction, a medium powder fraction, and a fine powder fraction. The medium powder fraction is recovered to provide a toner. The pulverizers may be an impact type pulverizer or jet-type pulverizer.

U.S. Pat. No. 4,923,778 (Blair et al.) discloses a process for preparing toner particles for liquid developers which comprises the steps of: (1) dispersing at an elevated temperature in a vessel a thermoplastic resin, pigment or colorant, and a hydrocarbon liquid; (2) cooling the dispersion in the vessel and precipitating the resin out of the dispersant; and (3) separating the dispersion of toner particles from the particulate media. The vessel may be an attritor, heated ball mill, heated vibratory mill which can disperse, grind, etc. Additional components can be added such as charge directors, adjuvants, etc.

U.S. Pat. No. 4,917,309 (Zander et al.) discloses a process for micronizing solid matter in a jet mill. The solid matter is introduced into the jet mill wherein micronizing occurs in the presence of milling aids and/or dispersing agents. The solid matter is introduced into the jet mill by means of an injector. The solid matter may include pigments.

U.S. Pat. No. 4,930,707 (Oshiro et al.) discloses a pneumatic pulverizer and a pulverizing method which pulverizes toner particles or colorant resin particles into a fine powder. The pneumatic pulverizer comprises an accelerating pipe for conveying and accelerating powder by high pressure gas, a pulverizing chamber, and an impinging member which pulverizes the powder jetted out from the accelerating pipe through impinging force.

U.S. Pat. No. 5,017,451 (Larson et al.) discloses a continuous process for the preparation of a dispersion of liquid and resin or polymer particles having at least one additive dispersed in the resin comprising: (1) introducing an intimate blend of resin and at least one additive continuously into, or blending the ingredients in, an apparatus having means for melting the resin and dispersing the additive in the resin; (2) melting the resin in the apparatus at an elevated temperature but below that at which the resin and/or additive decomposes; (3) moving continuously the blend of melted resin and additive through at least one mixing element of the apparatus dispersing thoroughly the additive in the melted resin (molten blend); (4) forming a dispersion by introducing into the molten blend, while still in at least one mixing element, a liquid in which the resin and additive(s) are substantially insoluble and thoroughly mixing molten blend in the liquid, the temperature in at least one mixing element being maintained above the temperature at which the molten blend remains in its molten state; and (5) introducing continuously the dispersion into a high shear cooling apparatus wherein the molten blend solidifies forming a stable dispersion of resin particles in the liquid. The process is useful for preparing resin particles in a liquid or electrostatic liquid developers more quickly and economically than by other processes, the resin or toner particles having controlled particle size.

U.S. Pat. No. 4,925,763 (Tsubuko et al.) discloses a liquid developer for electrophotography prepared by dispersing pigment and resin in a dispersing medium in a dispersion mixer, such as a ball mill, Keddy mill, or an attritor, to form a concentrate liquid developer, and diluting the concentrate liquid developer with carrier liquid. The dispersing medium is preferably the same as the carrier liquid of the developer. A thermoplastic resin and a charge controlling agent may be added to the liquid developer.

U.S. Pat. No. 4,966,825 (Suzuki et al.) discloses a method for producing an electrophotographic liquid developer comprising the steps of: (1) stirring a mixture comprising a coloring agent, an ethylenic copolymer and an electrically insulating liquid having an affinity with the copolymer; (2) dispersing the mixture in an electrically insulating liquid with a dispersing device having a dispersing action, such as, for example, a kneader, a Banbury mixer, a roll mill, a ball mill, an attritor, etc.; and (3) diluting the dispersion further with an electrically insulating liquid to provide a liquid developer. The mixture is cooled to a temperature lower than a softening point of the copolymer to be solidified. The solidified mixture is then coarsely ground. The electrically insulating liquid may be a carrier liquid. Charge controlling agents may be dispersed in the mixture.

U.S. Pat. No. 4,157,974 (Brechlin et al.) discloses a process for producing a liquid developer comprising the step of dispersing and grinding a pigment copolymer mixture in an electrically insulating carrier liquid. The liquid developer may contain dyestuffs, protective colloids, control agents and dispersing auxiliaries. The dispersing and grinding may be done in a two-roll mill, an extruder or a kneader. The solid is generally dispersed in a small amount of carrier liquid, and the mixture obtained is ground as additional carrier liquid is added.

Currently envisioned liquid developer printing machines require high solids replenishment to minimize the buildup of excess liquid carrier in the machine. This is because the liquid carrier and the toner are depleted at uneven rates depending on the amount of toner solids taken by each image, the degree to which carrier fluid imbibes into toner solids, the rate at which the paper or receiver sheet absorbs carrier fluid, and the rate at which carrier fluid is lost by evaporation. Theoretically, all carrier fluid is permanently contained in the printing machine and steps are taken to eliminate carrier losses.

Where image density is high, large quantities of toner solids are used while fluid loss is virtually zero. As toner solids are depleted, the volume of the bath changes negligibly. Replenishing the bath with toner concentrate at 10% solids, for example will cause the volume of the bath to grow very quickly, since 9 parts fluid are being added with every one part solids. Every added liter of concentrate causes the bath volume to grow nearly one liter. Consequently, the excess fluid must be removed, at considerable expense. As the efficiency of carrier fluid containment increases, it becomes necessary to replenish the developer with concentrates of increasingly higher concentration to prevent bath growth. However, desirably high concentrations have not previously been attained.

SUMMARY OF THE INVENTION

An object of this invention is to provide a method for replenishment of a liquid electrostatic developer which is suited to the requirements of a printing machine having extremely efficient carrier fluid containment. It is thus an object of this invention to provide a method of replenishing toner solids in a liquid electrostatic developer in a liquid electrostatographic printing machine, requiring little energy to break apart agglomerated particles.

These and other objects are achieved by the invention of a method for making and using a dispersible toner at 100% solids. The toner can be mixed into a suitable liquid carrier in a printing machine and charged by adding a carrier soluble surfactant. Mild sonication breaks up loose agglomerates.

DETAILED DESCRIPTION OF PREFERRED EMBODIMENTS

Containment of carrier fluid will be an important feature of currently envisioned liquid developer printing machines. It is sought to develop a machine which will operate as a completely closed system, and will eliminate operator handling of carrier fluid. Consequently, it will be necessary to have high solids replenishment of the liquid developer.

Since the cost of removing waste toner dispersant is considerable in liquid developer based printing machines, high solids replenishment is an important feature to eliminate bath growth.

Current liquid developers can only be concentrated to about 50% solids, beyond which redispersion is extremely difficult. The liquid developer replenisher of this invention has a toner solids concentration of about 100%, and can be dispersed with about five minutes of sonication to working strength concentration.

The high solids electrostatic developer replenisher of the invention comprises toner particles containing a friable thermoplastic resin.

An important property of toners of the present invention is brittleness, which causes the resin to fracture when impacted. This allows rapid particle size reduction in attritors, other media mills, or even jet mills used to make dry toner particles. These resins may be comprised of, for example, a urethane modified polyester which is a reaction product of a polyester resin and an isocyanate compound, a trimellitic anhydride treated carboxyl terminated polyester which is a reaction product of a diol and a dicarboxylic acid, or a carboxyl terminated polyester which is a reaction product of a dicarboxylic acid and a diol with the dicarboxylic acid having at least 6 carbons. The resin is mixed with a colorant.

The formation of urethane-modified polyester resins which may be used in the present invention is described in U.S. Pat. Nos. 4,833,057 (Misawa et al.) 4,981,923 (Hagiwara et al.) and 5,037,715 (Hagiwara et al.) (each of which is hereby incorporated by reference). There is, for example, a urethane-modified polyester resin (C) obtained by reacting a polyester resin (A) having a number average molecular weight of 1,000 to 15,000 with an isocyanate compound (B) in an amount of 0.05 to 0.95 mole-equivalent per mole of the hydroxyl group of the polyester resin (A). The urethane-polyester resin (C) has a glass transition temperature of about 40°--about 80° C. The formation of suitable carboxyl terminated resins is described in U.S. Pat. Nos. 5,006,612 (Danick) and 3,397,254 (Wynstra).

The resin may be blended with any suitable colorant. Suitable pigments include, but are by no means limited to, carbon black for producing a black toner; 2,9-dimethyl-substituted quinacridone and anthraquinone dye (identified in the color index as CI 60710), CI Dispersed Red 15, a diazo dye identified in the color index as CI 26050, and CI solvent Red 19 for producing a magenta toner; copper tetra-4(octadecyl sulfonamido)phthalocyanine, X-copper phthalocyanine pigment (listed in the color index as CI 74160), CI Pigment Blue, and Anthrathrene Blue, identified in the color index as CI 69810, and Special Blue X-2137, for producing a cyan toner; diarylide yellow 3,3-dichlorobenzidene acetoacetanilides, a monoazo pigment identified in the color index as Foron yellow SE/GLN, CI dispersed yellow 33, 2,5-dimethoxy-4-sulfonanilide phenylazo-4'-chloro-2,5-dimethoxy acetoacetanilide, and permanent yellow FGL for producing a yellow toner.

Examples of other pigments that may be used include:

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Heubach | Yellow 74 |
| Hansa Yellow X | Hoechst | Yellow 75 |
| Novoperm ® Yellow HR | Hoechst | Yellow 75 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L75-1331 Yellow | Sun Chem. | |

-continued

| Pigment Brand Name | Manufacturer | Colour Index Pigment |
|---|---|---|
| L75-2377 Yellow | Sun Chem. | |
| Hostaperm ® Orange GR | Hoechst | Orange 43 |
| Paliogen ® Orange | BASF | Orange 51 |
| Irgalite ® 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | |
| Mogul L | Cabot | |
| BK 8200 Black Toner | Paul Uhlich | |

The pigment and the resin may be blended in any suitable manner. Preferably, they are melt blended, more preferably in an extruder such as a twin screw extruder to permit continuous production. The screw elements are configured to grind, and the pigment is broken up into sub-micron particles and dispersed into the resin. The ratio of resin to pigment to be added is preferably about 80% to about 20% by weight. However, the ratio of resin to pigment may range from about 40% to about 99.9% by weight resin to about 60% to about 0.1% by weight pigment.

In a preferred twin screw extruder, there are three specific temperature zones. In the feed zone, resin, additive and pigment are metered into the extruder. The temperature is maintained below the resin melt point. If the resin begins to melt at the feed port, the entry clogs, and the extruder often stalls.

In the mixing zone, the temperature of the barrel is held just above the resin melting point, at approximately 111° C. bringing the conveyed mass to a high viscosity, molten state. Reverse directing screw elements cause the advancing blend to swirl backwards into the forward-moving blend, causing a rise in pressure. In this high energy state, pigment particles are crushed and blended into the molten resin. Pigment and optional additives mix uniformly into the liquified resin. If, during this stage, the temperature is temporarily lowered, the resin viscosity increases.

At the discharge port, the temperature is raised up to about 170° C. to fluidize the extrudate and causes it to flow freely out the exit. The pressure in the preceding mixing zone can be increased by restricting the size of the exit hole, at the expense of throughput.

The screws are preferably turned at the fastest rate which allows the molten resin to achieve the desired temperatures. Faster screw speeds provide higher energy mixing and greater throughputs, but above a certain rate, the resin is moving too fast to equilibrate with the barrel temperature, and dispersion quality degrades.

As an example, a Werner Pfleiderer WP-28 extruder equipped with a 15 horsepower motor is well-suited for melt-blending the resin and a pigment. This extruder has a 28 mm barrel diameter, and is considered semiworks-scale, running at peak throughputs of about 3 to 12 lbs/hour.

Dispersion quality improves when a "masterbatch" process is used. The resin is first extruded with a very high loading of pigment, for example 50% for cyan, magenta, and yellow, and 30% for black. The pigment acts as a self-grinding medium. This finished extrudate is then milled to a coarse powder and mixed, or "let down" with pure resin to lower pigment loading to the desired value. The mixture is passed through the extruder to produce the final product.

This masterbatch process is carried out in two discrete extrusions. An improved process begins as a normal batch, where a rich pigment-resin mixture is introduced at the feed port. This is melted and mixed, and at the end of the mixing zone, additional molten resin is injected into the extruder, and mixed in the next heating zone of the extruder. The product has the dispersion quality of the product of a full masterbatch process, but is delivered from the extruder at the proper pigment loading in a single pass.

A three roller miller or a Brabender ® mill, which is similar to an attritor, may be used as an alternative method of reducing the size of the toner particles.

A pulverizer may be used for this purpose. The pulverizer may be a hammer mill such as, for example, an Alpine ® Hammer Mill. The hammer reduces the toner particles to a size of about 100 μm to about 300 μm.

Prior to pulverizing the toner particles, a rotary cutter, such as an Alpine ® Cutter or Fitz ® Miller, may be used to reduce the size of the resin particles.

After the resin and the pigment have been blended together, the particles of the resin-pigment mixture are further reduced in size.

A jet type micronizer such as a jet mill is preferred for micronization. Jet mills consist of a milling section into which water vapor jets or air jets are blown at high speeds, and the solid matter to be micronized is brought in across an injector by a propellant. Compressed air or water vapor is usually used as the propellant in this process. The introduction of the solid matter into the injector usually occurs across a feeding hopper or an entry chute.

Milling aids are also often added to the solid matter in order to support the micronization.

For example, a Sturtevant 15 inch jet mill having a feed pressure of about 114 psi and a grinding pressure of about 119 psi may be used in the preparation of the friable thermoplastic toner resin particles. The nozzles of this jet mill are arranged around the perimeter of a ring. Feed material is introduced by a pneumatic delivery device and transported to the injector nozzle. The particles collide with one another and are attrited. These particles stay in the grinding zone by centrifugal force until they are small enough to be carried out and collected by a cyclone separator. A further size classification is performed by an air classifier.

After particle size reduction, the toner particles have an average particle size of less than 30μ, preferably less than 15μ, more preferably less than 10μ, as measured using a Malvern 3600E Particle Sizer ® manufactured by Malvern, Southborough, Mass., which uses laser diffraction light scattering of stirred samples to determine average particle sizes. Various instruments are known to measure particle size in addition to the Malvern instrument, such as the Horiba CAPA-500 ® centrifugal particle analyzer, manufactured by Horiba Instruments, Inc., Irvine, Calif. In determining particle size by area, a solvent viscosity of 1.24 cps, solvent density of 0.76 g/cc, sample density of 1.32 using a centrifugal rotation of 1,000 rpm, a particle size by area range of 0.01 to less than 10 μm, and a particle size by area cut of 1.0 μm are used.

Since these two instruments use differing techniques to measure average particle size, the readings differ. The following correlation of the average size of toner particles in micrometers for the two instruments is:

| Value Determined By Malvern 3600E Particle Sizer | Expected Range For Horiba CAPA - 500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification, the particle size values are as measured using the Malvern instrument.

The dry, fine-particle sized toner, in which the size of the toner particles ranges from about 5 to about 10 microns, may be mixed into a liquid developer in an electrostatographic printing machine.

A sufficient amount of toner particles may be added to the liquid developer to maintain or replenish a working strength concentration of the toner resin. The toner resin may be redispersed in the carrier fluid by, for example, sonicating the resin in a desired amount of carrier fluid, for example for about 3–8 minutes. Alternatively, the toner can also be redispersed with a point sonicator. Other methods of sonication or redispersion may be used to achieve the desired concentration.

Preferred toner dispersants for the liquid developer include a non-polar liquid having a kauri-butanol value of less than 30. Preferably, it is a branched-chain aliphatic hydrocarbon. More particularly, a non-polar liquid of the Isopar ® series may be used. These hydrocarbon liquids are narrow cuts of isoparaffinic hydrocarbon fractions with extremely high levels of purity. For example, the boiling range of Isopar ®G is between 157° C. and 176° C.; Isopar ®H is between about 176° C. and 191° C.; Isopar ®K is between about 177° C. and 197° C.; Isopar ®L is between 188° C. and 206° C.; Isopar ®M is between 207° C. and 254° C.; and Isopar ®V is between 254.4° C. and 329.4° C. Isopar ®L has a mid-boiling point of approximately 194° C. Isopar ®M has an auto ignition temperature of 338° C. Isopar ®G has a flash point of 40° C. as determined by the tag closed cup method; Isopar ®H has a flash point of 53° C. as determined by the ASTM D-56 method; Isopar ®L has a flash point of 61° C. as determined by the ASTM D-56 method and Isopar ®M has a flash point of 80° C. as determined by the ASTM D-56 method and an auto-ignition temperature of 338° C. They are substantially odorless, possessing only a very mild paraffinic odor. They have excellent odor stability and are all manufactured by the Exxon Corporation. High-purity normal paraffinic liquids, Norpar®12, Norpar®13 and Norpar®15 (Exxon Corporation) may also be used. They have flash points of 69° C., 93° C. and 118° C., respectively, and have auto-ignition temperatures of 204° C., 210° C. and 210° C., respectively.

Since image formation depends on the differences of the charge between the liquid developer and the latent electrostatic image to be developed, it is desirable to add a charge director and/or an adjuvant. As an example, adjuvants which can be melt blended with the resin can be selected from the group consisting of a polyhydroxy compound which contains at least 2 hydroxy groups, amino-alcohol, polybutylene succinimide, metallic soap, and aromatic hydrocarbon having a Kauributanol value of greater than 30. The adjuvants are generally used in an amount of 1 to 1000 mg/g, preferably 1 to 200 mg/g developer solids. Examples of the various above described adjuvants include:

polyhydroxy compounds: ethylene glycol, 2,4,7,9-tetramethyl-5-decyn-4,7-diol, poly(propylene glycol), pentaethylene glycol, tripopylene glycol, trimethylene glycol, glycerol, pentaerythritol, glycerol-tri-12 hydroxystearate, ethylene glycol monohydroxystearate, propylene glycerol monohydroxystearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl) ethylenediamine, etc. as described in Larson U.S. Pat. No. 4,702,985.

polybutylene/succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristerate; aluminum distearate; barium, calcium, lead and zinc stearate; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444 and is an additive. The metallic soap can be present in an amount of 0.01 to 60% in weight based on the total weight of solids.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 Alkyl-substituted benzenes manufactured by Exxon Corp., etc. as described in Mitchell U.S. Pat. No. 4,631,244.

The disclosures of the above-listed United States patents describing the adjuvants are incorporated herein by reference.

To acquire a negative or positive charge from a chemical dissociation reaction on the toner particles, a charged species may be introduced in the carrier liquid to form a counterion. A charge director in the liquid developer influences or is responsible for electrical charging of the toner. The charge director may have a positive or negative charging effect. Mostly oil-soluble ionogenic substances (surfactants), e.g., metallic salts of organic acids with long aliphatic chains (e.g., containing at least 6 carbon atoms), are used for that purpose. By predominant adsorption of one ionic species, the toner particles receive a net charge whose amount can be regulated by changing the additive concentration. In this way the sensitivity of the toner (i.e., deposited mass per surface charge) can be controlled. The polarity can be determined by appropriate choice of the surfactant. Mixtures of different charge directors can be used. For example, a mixture of different charge directors having opposite charging effects can be used so that the strength of the charge on the toner or the polarity thereof can be adjusted by varying the ratio between the different charge directors. Particularly suitable positively working charge directors are bivalent or trivalent metal salts of:

(a) a monoester or diester of an oxyacid derived from phosphorus;

(b) an oxyacid derived from phosphorus and containing one or two organic groups linked to the phosphorus atom by a carbon atom; or (c) an oxyacid derived from phosphorus and containing an ester group and an organic group linked by a carbon atom to the phosphorus atom, the organic group being aliphatic, cycloaliphatic or aromatic.

The organic groups preferably comprise a chain of at least 4 carbon atoms, most preferably from 10–18 carbon atoms, and such a chain may be substituted and/or interrupted by hetero-atom(s), e.g. oxygen, sulphur, or nitrogen atom(s).

Particularly good results are obtained with barium salts. However, other salts may be used, e.g. magnesium salts, calcium salts, strontium salts, zinc salts, iron salts, cobalt salts, nickel salts, copper salts, cadmium salts, aluminum salts, and lead salts.

The solubility in the electrically insulating carrier liquid of such metal salts can be promoted by the presence of one or more organic groups with a branched structure, e.g., branched aliphatic groups, such as a 2-butyl-octyl group.

In a preferred embodiment, particularly useful or effective charge directors are metal alkyl sulphonates in which the metal ion is a bivalent metal ion selected from the group consisting of zinc(II), lead(II), cadmium(II), copper(II) and barium(IIA), or is a trivalent metal ion of the group VIII of the Periodic Table of the Elements, e.g., iron (III), or of the group VIB, e.g., chromium-(III), and in which the sulphonate group is present directly on an alkyl chain containing at least 6 carbon atoms in a straight line.

A suitable amount of the sulphonate for a given developer can be easily determined by simple tests. By using a metal alkyl sulphonate as a charge control agent the specified results can be achieved with toner particles of a size commonly used in the electrophotographic art, e.g., with toner particles in the range of 0.2 to 2 μm. An additional charge director can be used in conjunction with the metal alkyl sulphonate, but this is not a requirement to charge the liquid resin toner.

As an example of a preferred embodiment of the present invention, the surfactant Basic Barium Petronate from Witco is used as a charge director. Barium Petronate is a barium salt of a sulfonated chain 16–20 carbons long. After the toner resin has been redispersed to about 1% solids, Barium Petronate may be added at the rate of about 15 mg of charge director per gram of toner solids. The amount of charge director which may be added ranges from about 15 mg of charge director to about 1 gram of charge director per gram of toner resin, with the optimum range of charge director being about 15 mg to about 150 mg, with 40 mg being the preferred amount of charge director added per gram of 1½ percent working strength concentration toner resin and 10 mg of charge director added per gram of concentrated toner resin. Conductivity of the developer toner should be about 10 pmho/cm.

Other charge directors which may be used with this resin include positive charge directors, e.g., anionic glycerides such as Emphos® D70-30C, Emphos® F27-85, etc., manufactured by Witco Chem. Corp., New York, N.Y.; sodium dioctylsulfosuccinate (manufactured by American Cyanamid Co.); ionic charge directors such as zirconium octoate, copper oleate, iron naphtenate, etc.; and nonionic charge directors such as polyethylene glycol sorbitan stearate.

While the invention has been described with reference to the structures and embodiments disclosed herein, it is not confined to the details set forth, and encompasses such modifications or changes as may come within the purpose of the improvements and the scope of the claims.

What is claimed is:

1. A method of replenishing toner solids in a liquid electrostatic developer in a liquid electrostatographic printing machine, comprising adding dry toner particles comprising a friable thermoplastic resin and a colorant to a toner solids depleted liquid electrostatic developer in said machine.

2. The method of claim 1, wherein said dry toner particles are prepared by mixing said friable thermoplastic resin and said colorant;

reducing the colorant and resin to a coarse powder; and milling the coarse powder to form a dry, fine particle-sized toner.

3. The method of claim 2, wherein said friable thermoplastic resin and said colorant are mixed in an extruder.

4. The method of claim 3, wherein said extruder is a twin screw extruder.

5. The method of claim 1, wherein a mill is used to reduce the colorant and resin to a coarse powder.

6. The method of claim 5, wherein said mill is a hammer mill.

7. The method of claim 5, wherein a micronizer is used to mill the coarse powder to form the dry, fine particle-sized toner.

8. The method of claim 5, wherein a jet mill is used to mill the coarse powder to form the dry fine particle-sized toner.

9. The method of claim 7, wherein particles of the fine particle-sized toner are collected in a cyclone separator.

10. The method of claim 7, wherein particles of the fine particle-sized toner are separated in an air classifier.

11. The method of claim 1, wherein a particle size of said toner particles is between about 0.5 to about 10 microns.

12. The method of claim 1, further comprising the step of adding a charge director to the liquid developer.

13. The method of claim 12, wherein said charge director is a metallic salt of an organic acid.

14. The method of claim 13, wherein said charge director is a metallic salt of a monoester or diester of an oxyacid selected from the group consisting of an oxyacid derived from phosphorous, an oxyacid derived from phosphorous and containing one or two organic groups linked to the phosphorus atom by a carbon atom, and an oxyacid derived from phosphorus and containing an ester group linked by a carbon atom to the phosphorous atom; a metal alkyl sulphonate; or lecithin.

15. The method of claim 1, wherein a fine particle size inorganic oxide is blended with the toner particles.

16. The method of claim 1, wherein the toner particles have dispersed therein a metallic soap.

17. The method of claim 16, wherein the metallic soap is aluminum tristearate.

18. A method of replenishing toner solids in a liquid electrostatographic developer in a liquid electrostatographic printing machine, comprising the steps of:

(A) blending resin and pigment to form a toner;

(B) milling said blended toner to an average particle size of less than 30 μm; and (C) adding said toner as dry particles to a liquid developer in an electrostatographic printing machine.

19. The method of claim 18, further comprising the step of (D) dispersing said toner in said liquid developer by sonication.

20. The method of claim 18, wherein step (B) comprises milling said blended toner to an average particle size of less than 10 μm.

* * * * *